United States Patent [19]

Kellogg et al.

[11] Patent Number: 5,033,352

[45] Date of Patent: Jul. 23, 1991

[54] ELECTRONIC MUSICAL INSTRUMENT WITH FREQUENCY MODULATION

[75] Inventors: Steven L. Kellogg; Jack A. Kellogg, both of Santa Cruz, Calif.

[73] Assignee: Yamaha Corporation, Hamamatsu, Japan

[21] Appl. No.: 554,962

[22] Filed: Jul. 20, 1990

Related U.S. Application Data

[63] Continuation of Ser. No. 299,731, Jan. 19, 1989, abandoned.

[51] Int. Cl.[5] ..... G10H 1/057; G10H 1/14

[52] U.S. Cl. ..... 84/658; 84/660; 84/663; 84/DIG. 10; 331/78

[58] Field of Search ..... 84/615-620, 84/624, 627, 653-661, 663, 678-690, 694-696, 702, 703, DIG. 4, DIG. 10; 331/78

[56] References Cited

U.S. PATENT DOCUMENTS

| | | | |
|---|---|---|---|
| 3,978,755 | 9/1976 | Woron | 84/DIG. 4 |
| 4,249,447 | 2/1981 | Tomisawa | 84/1.01 |
| 4,554,857 | 11/1985 | Nishimoto | 84/1.19 |
| 4,655,115 | 4/1987 | Nishimoto | 84/1.19 |
| 4,736,663 | 4/1988 | Wawrzynek et al. | 84/DIG. 10 |
| 4,785,706 | 11/1988 | Toshifumi | 84/1.19 |
| 4,813,326 | 3/1989 | Hirano et al. | 84/1.01 |

*Primary Examiner*—Stanley J. Witkowski

*Attorney, Agent, or Firm*—Spensley, Horn, Jubas & Lubitz

[57] ABSTRACT

An electronic musical instrument having a plurality of operators for generating audio frequency waveforms and performing frequency modulation thereof. The operator comprises a wave generator, a phase generator, and an amplitude-envelope generator. The phase generator produces phase-angle data on the basis of frequency-number data modulated by ratio-of-frequency data. While the frequency-number data is common to all operators, ratio-of-frequency data varies independently of those applied to the other operators. This enables operators to create rich, dynamic, lifelike sound. One or more operators are provided with feedback loops that are capable of varying the amount of the feedback in response to key touch, etc., thus achieving expressive tone. A pitch-envelope generator is provided with a random-number generator which modulates the pitch envelope in a random manner to more closely simulate a performance on a real musical instrument. Furthermore, the frequency number is adjusted by altering just a few parameters, which makes it possible to carry out temperament easily.

15 Claims, 13 Drawing Sheets

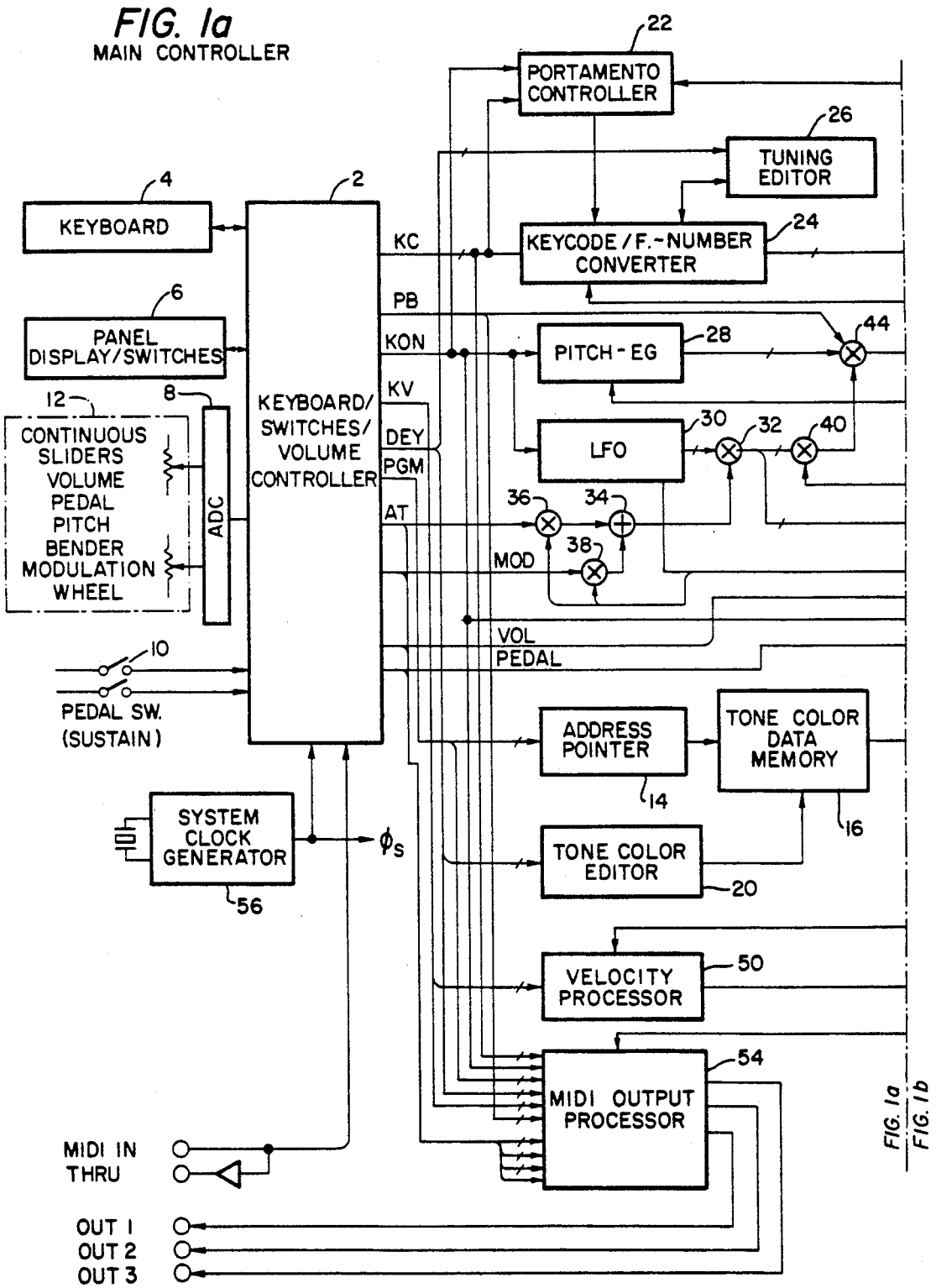
FIG. 1a
MAIN CONTROLLER
22
PORTAMENTO CONTROLLER
26
TUNING EDITOR
4
KEYBOARD
2
KC
KEYCODE / F.-NUMBER CONVERTER
24
6
PANEL DISPLAY/SWITCHES
PB
KON
PITCH-EG
28
44
12
8
CONTINUOUS SLIDERS
VOLUME
PEDAL
PITCH BENDER
MODULATION WHEEL
ADC
KEYBOARD/ SWITCHES/ VOLUME CONTROLLER
KV
DEY
PGM
AT
LFO
30
32
40
36
34
38
MOD
VOL
PEDAL
10
PEDAL SW. (SUSTAIN)
ADDRESS POINTER
TONE COLOR DATA MEMORY
14
16
SYSTEM CLOCK GENERATOR
56
$\phi_S$
TONE COLOR EDITOR
20
VELOCITY PROCESSOR
50
54
MIDI OUTPUT PROCESSOR
FIG. 1a
FIG. 1b
MIDI IN
THRU
OUT 1
OUT 2
OUT 3

MAIN CONTROLLER

TONE GENERATOR

TONE GENERATOR

OPERATOR

KON
L1
R1
R2
L2
R3
L3
R4
L4
FIG. 7b RATE REG. INPUT
FIG. 7c LEVEL REG. INPUT
FIG. 7d WRITE
FIG. 7e RATE REG. OUTPUT
FIG. 7f LEVEL REG. OUTPUT
FIG. 7g KON
FIG. 7h SEG
FIG. 7i RN
FIG. 7j LATCH
FIG. 7k LN
FIG. 7l RPEG (RANDOM MODE)
L1 + RN1
L2+RN2
L3+RN3
L4+RN4
RN1
RN2
RN3
RN4

| OCTAVE | KEYNAME |
|---|---|
| 7 6 5 4 | 3 2 1 0 |
| 0000=-2 | 0000 C* |
| 0001=-1 | 0001 D |
| 0010= 0 | 0010 D* |
| 0011= 1 | 0100 E |
| 0100= 2 | 0101 F |
| 0101= 3 | 0110 F* |
| 0110= 4 | 1000 G |
| 0111= 5 | 1001 G* |
| 1000= 6 | 1010 A* |
| 1001= 7 | 1101 B |
| 1010= 8 | 1110 C |

KEY CODE

| | |
|---|---|
| B | 0 CENT |
| A# | -8 CENT |
| A | +5 CENT |
| G# | 0 CENT |
| G | 0 CENT |
| F# | +5 CENT |
| F | +5 CENT |
| E | 0 CENT |
| D# | -8 CENT |
| D | +8 CENT |
| C# | +5 CENT |
| C | -5 CENT |

ELECTRONIC MUSICAL INSTRUMENT WITH FREQUENCY MODULATION

This is a continuation of copending application Ser. No. 299,731, filed on Jan. 19, 1989 and now abandoned.

BACKGROUND OF THE INVENTION

1. Field of the Invention

This invention relates to an electronic musical instrument. More particularly, the invention relates to a synthesizer type electronic musical instrument which comprises a plurality of operation units (operators) which perform waveform generation and frequency modulation thereof.

2. Prior Art

An electronic musical instrument and a method of the type are disclosed in U.S. Pat. No. 4,554,857 and U.S. Pat. No. 4,249,447.

First, the instrument disclosed in U.S. Pat. No. 4,554,857 has a plurality of operators (six, for example) to generate a number of waves and perform the modulation thereof. The operator includes a wave generator that contains a sine wave table having sine wave data, a phase generator that generates phase data that designates the address of the sine wave table, and an amplitude-envelope generator that modulates output data from the sine wave table. The phase generator generates the phase data on the basis of frequency-number data that indicates the frequency of a depressed key, and the wave generator then generates a waveform corresponding to the phase data. The wave generator has as one of its functions to modulate phase data by use of external data and/or output data of other operators, so that the phase data has complex variations over time, and hence the operator can produce a rich, dynamic sound. These operators are arranged in a number of different configurations called algorithms. In FIG. 5 of the above U.S. Pat., thirty-one algorithms A-1 to A-31 are shown. Depending on its location in an algorithm, an operator will function either as a modulator or a carrier generator, producing a broad range of tones. A performer selects, before performance, one of these algorithms to obtain the tones he desires.

Second, the U.S. Pat. No. 4,249,447 discloses a method for generating waves having a desired harmonic structure by means of an operator that has a feedback loop. The desired harmonic structure can be obtained by varying feedback parameter $\beta$.

The instrument or method mentioned above is an effective and powerful one. However, there are still some problems to be solved, as follows:

(a) Although the phase data produced from each phase generator can be modulated independently, the frequency-number data applied to the phase generator is common to all the operators. In other words, pitch data (i.e., frequency-number data) applied to each phase generator is the same data. This imposes limits on creating wide-ranging and complex tones.

(b) Conventionally, feedback parameter $\beta$ of the operator is kept constant during a performance, that is, it must be set before a performance and cannot be varied during the performance. Setting the feedback parameter $\beta$, or an algorithm of the operators before performance makes it possible to produce a wide range of tone colors. However, this also imposes certain limits on achieving expressive performance. This is because key touch cannot effect variation of feedback parameter $\beta$, and hence, it is not possible to obtain a drastically changing, dynamic tone with variation of touch.

(c) A conventional pitch-envelope generator produces an envelope defined by a predetermined rate and level of data. Consequently, an envelope pattern is kept constant as long as the tone is not changed. In a real musical instrument (particularly in wind instruments), however, delicate pitch variance occurs in every note because of fine changes in expiration and lip movement. The conventional instrument or method cannot simulate the delicate undetermined pitch variance.

(d) The frequency-number table is used to correlate a keycode and frequency-number data that determines the pitch of a key. A certain conventional instrument is provided with a tuning editor that rewrites contents of a frequency-number table so that an arbitrary frequency number is assigned to a desired key. Hence arbitrary pitch can be assigned to a desired key. The assignment of pitch data to each key, however, is very tedious and is time consuming.

SUMMARY OF THE INVENTION

It is therefore an object of the present invention to provide an electronic musical instrument whereby frequency-number data applied to one or more phase generators are selectively modulated independently of the frequency-number data applied to the other phase generators, so that a more complex, dynamic, lifelike tone can be achieved.

Another object of the invention is to provide an electronic musical instrument whereby feedback parameter $\beta$ is able to be varied in response to touch data such as key-velocity data, aftertouch data, and so on. Thus, more expressive performance can be achieved.

A further object of the invention is to provide an electronic musical instrument whereby pitch-modulation data applied to operators are modified in response to random numbers, so that a more complex and lifelike sound, resembling that produced by an actual instrument, can be achieved.

A still further object of the invention is to provide an electronic musical instrument whereby temperament of the instrument is easily carried out by use of a few parameters relating to the temperament.

In a first aspect of the present invention, there is provided an electronic musical instrument comprising: frequency-number data generating means for generating a frequency-number corresponding to a musical tone frequency to be generated; a plurality of operators respectively performing a waveform generation and modulation thereof on the basis of the frequency-number data and/or modulation data applied to one or more inputs; setting means for variably setting a combination of input and output connections between the respective operators; connection switching means for switching connections between the respective operators in response to the combination of connections set by the setting means; and modulating means for selectively and independently modulating the frequency-number data applied to one or more the operators by frequency-number modulation data supplied thereto.

In a second aspect of the present invention, there is provided an electronic musical instrument comprising: a plurality of operators respectively performing a waveform generation and modulation thereof on the basis of frequency-number data and/or modulation data applied to one or more inputs; setting means for variably setting a combination of input and output connections between the respective operators; connection switching means for switching connections between the respective operators in response to the combination of connections set by the setting means; feedback means being provided for one or more the operators for feeding back output to input of the same operator with variable feedback parameter $\beta$; and control data generating means for generating control data to control the feedback parameter $\beta$ in accordance with external parameter changing according to at least one of performance and lapse of time. In a third aspect of the present invention, there is provided an electronic musical instrument comprising: random number generating means for generating a random number; pitch envelope generating means for generating pitch-modulation data in accordance with the random number supplied thereto; a plurality of operators respectively performing a waveform generation in response to the pitch-modulation data; setting means for variably setting a combination of input and output connections between the respective operators; and connection switching means for switching connections between the respective operators in response to the combination of connections set by the setting means.

In a fourth aspect of the invention, there is provided an electronic musical instrument comprising: frequency-number data generating means for generating frequency-number data by converting a keycode thereto; musical tone generating means for generating musical tones in response to the frequency-number data; computing means for computing pitch deviation of each note from equal temperament on the basis of temperament parameters; and supplying means for supplying the temperament parameters to the computing means.

DESCRIPTION OF THE PREFERRED EMBODIMENT

The invention will now be described with reference to the accompanying drawings.

Figure 1B:
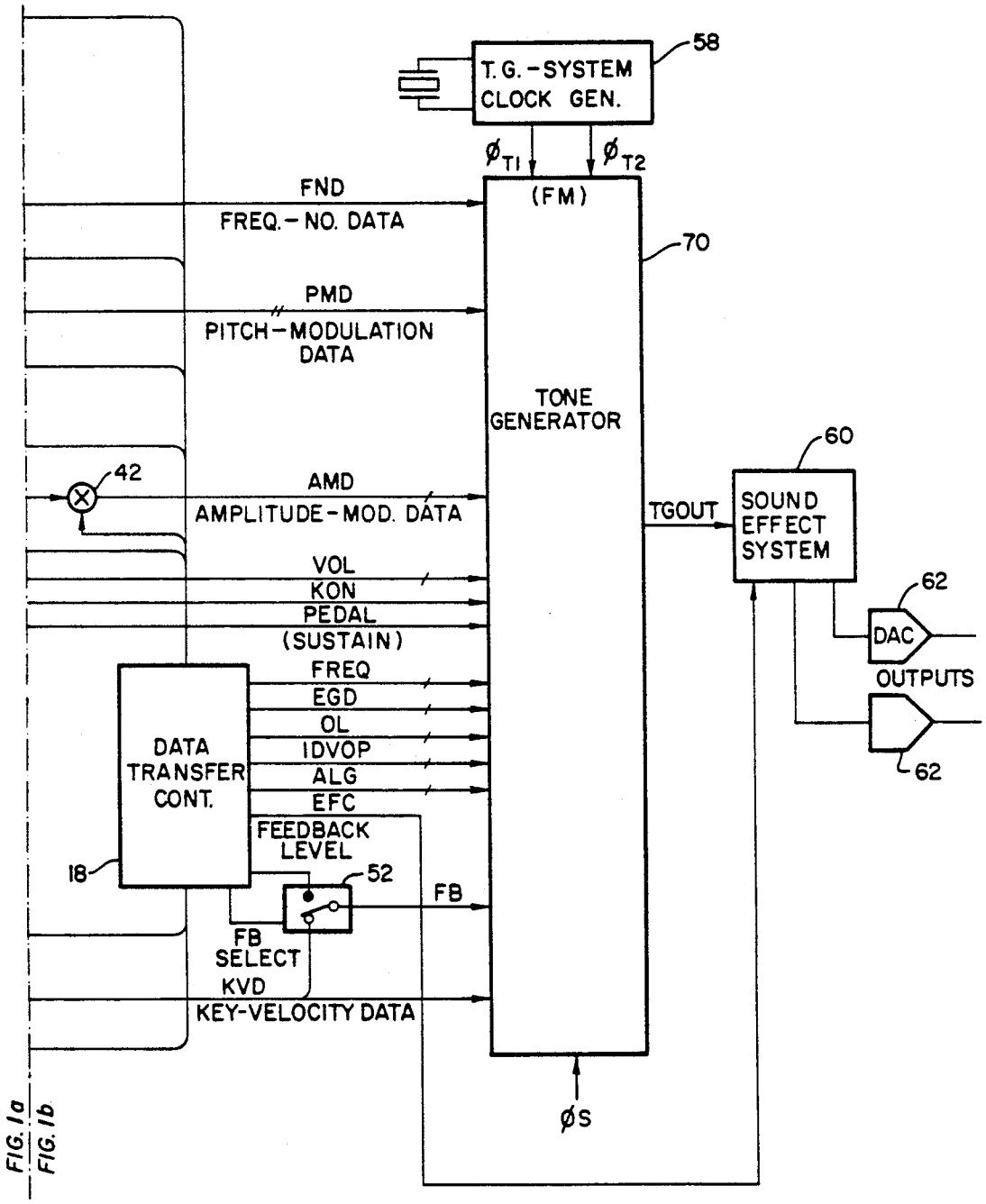
FIG. 1 is a block diagram of a main controller of an electronic musical instrument according to an embodiment of the invention.

FIG. 1 is a block diagram of a main controller of an embodiment of the present invention.

In FIG. 1, numeral 2 designates keyboard/switches/-volume controller (hereafter, called interface controller 2) whose input terminals are connected to a keyboard 4, display and switches 6 on a panel, analog-to-digital converter (ADC) 8, and pedal switch (sustain switch) 10. To input terminals of ADC 8, are applied various performance parameters from external operation members 12 such as continuous sliders, volume pedal, pitch-bender wheel, modulation level wheel and so on. These performance parameters, which are analog signals, are converted to digital data by the ADC 8 and supplied to the interface controller 2. The interface controller 2 produces program number PGM indicative of tone color in accordance with a player's selection. The program number PGM is conveyed to an address pointer 14. The address pointer 14 produces addresses of a tone-color-data memory 16 and supplies the address to it. The tone-color-data memory 16 prestores tone-color data and other parameters such as temperament data, performance data, and system setting data. Read out data from the tone-color-data memory 16 is delivered to various parts of the main controller via a data transfer controller 18. Content of the tone-color-data memory 16 can be rewritten by a tone color editor 20 to which entry data DEY is supplied from the interface controller 2.

Portamento data stored in the tone-color-data memory 16 is transferred to a portamento controller 22. The portamento controller 22 operates so that smooth carrying from note to note can be achieved in accordance with keycode data KC and key-on data KON supplied from the interface controller 2. The keycode data KC and key-on data KON are produced by the interface controller 2. Specifically, the interface controller 2 scans the keyboard 4 to find depressed keys and produces keycode KC indicative of depressed keys, and key-on data KON representing whether these keys are still being depressed or have already been released. In practice, this is performed on a time-sharing basis and keycode data KC and key-on data KON are assigned to an available time slot by the interface controller 2. Output data of the portamento controller 22 is applied to a keycode/frequency-number converter 24.

The keycode/frequency-number converter 24 converts the keycode KC to frequency-number data FND using a frequency-number table. The frequency-number table can be rewritten by tuning editor 26 so that correlation between keycode KC and frequency-number data FND are free to set. The key-on data KON is also supplied to a pitch-envelope generator 28 and a low-frequency oscillator (LFO) 30. The pitch-envelope generator 28 produces pitch-envelope data on the basis of rate and level parameters delivered from the tone-color-data memory 16 via data transfer controller 18. More details of the keycode/frequency-number converter 24 and the pitch-envelope generator 28 will be described later.

The LFO 30 generates low frequency data in accordance with key-on data KON. The low frequency data is used for modulating output data of the pitch-envelope generator 28. The low frequency data is supplied to a multiplier 32 where data from an adder 34 is also applied. The adder 34 adds output data from multipliers 36 and 38. These multipliers 36 and 38 respectively multiply aftertouch data AT and modulation data MOD from the interface controller 2 by level variation data supplied from the tone-color-data memory 16 via the data transfer controller 18. Aftertouch data AT and modulation data MOD thus modified are added by the adder 34 and the resultant data supplied to the multiplier 32, which in turn modifies low frequency data from the LFO 30. The modified data is applied to two multipliers 40 and 42 which multiply the applied data by respective data from the tone-color-data memory 16.

The output data from the multiplier 40 and pitch bend data PB from the interface controller 2 are applied to an adder 44 which adds these data to the data from the pitch-envelope generator 28 to obtain pitch-modulation data PMD. On the other hand, the output data from the multiplier 42 is used as amplitude-modulation data AMD.

Key velocity KV is produced by the interface controller 2 on the basis of the period between depression and release timing of a key and is supplied to a velocity processor 50. The velocity processor 50 converts key velocity KV to key-velocity data KVD using the velocity curve supplied thereto from the tone-color-data memory 16 via the data transfer controller 18. The key-velocity data KVD is transferred to a select switch 52 which selects either the key-velocity data KVD or feedback level data supplied from the data transfer controller 18, and outputs the selected data as feedback data FB.

MIDI (Musical Instrument Digital Interface) output processor 54 converts parameters such as program number PGM, data entry DEY, key velocity KV, and pitch bend PB to MIDI standard and outputs them from output terminals OUT1 to OUT 3. The main controller is also provided with terminals MIDI IN and THRU for receiving external MIDI data, and supplies the data to the interface controller 2.

The main controller comprises a system clock generator 56 that supplies scan clock Øs to the interface controller 2, and a tone-generator-clock generator 58 that supplies clocks Ø1 and Ø2 to a tone generator 70. To the tone generator 70 various input data are supplied from the main controller; frequency-number data FND, pitch-modulation data PMD, amplitude-modulation data AMD, volume data VOL, key-on data KON, pedal data (sustain data) PEDAL, feedback data FB, key-velocity data KVD, and other data from the data transfer controller 18. The data transfer controller 18 retrieves data stored in the tone-color-data memory 16 and supplies them to the tone generator 70. These data are constant as long as tone color is not changed and include such data as frequency data FREQ, envelope-generation data EGD, output-level data OL, individual-operation data IDVOP, and algorithm data ALG. Details of these data will be described later.

Effect data EFC from the data transfer controller 18 is supplied to a sound effect system 60 to effect echo or reverberation. Output of the sound effect system 60 is applied to digital to analog converters (DAC) 62 provided for each channel to produce analog output signals.

Figure 2A:
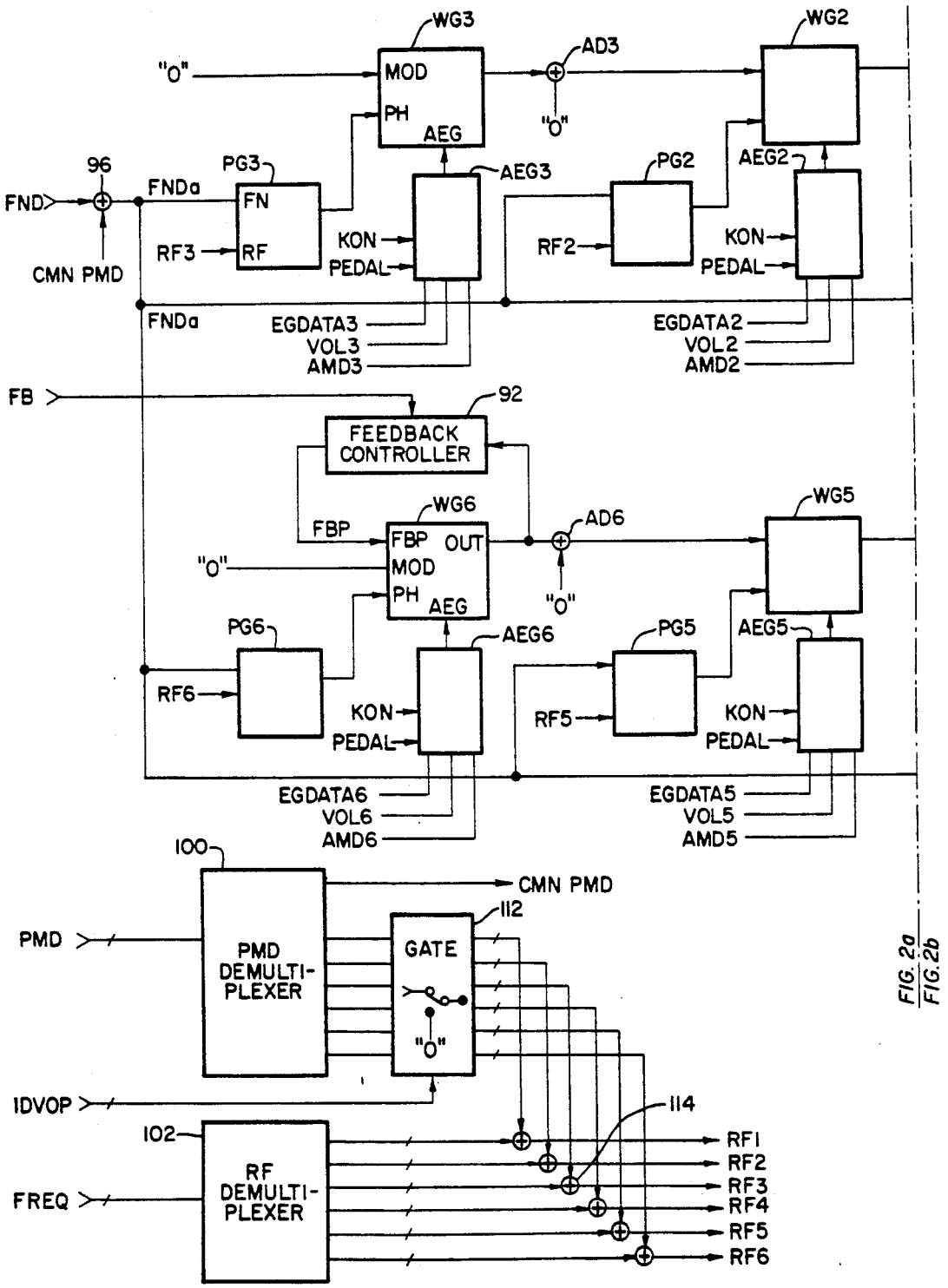
FIG. 2 is a block diagram showing an electrical configuration of a tone generator 70 of the electronic musical instrument.
Figure 2B:
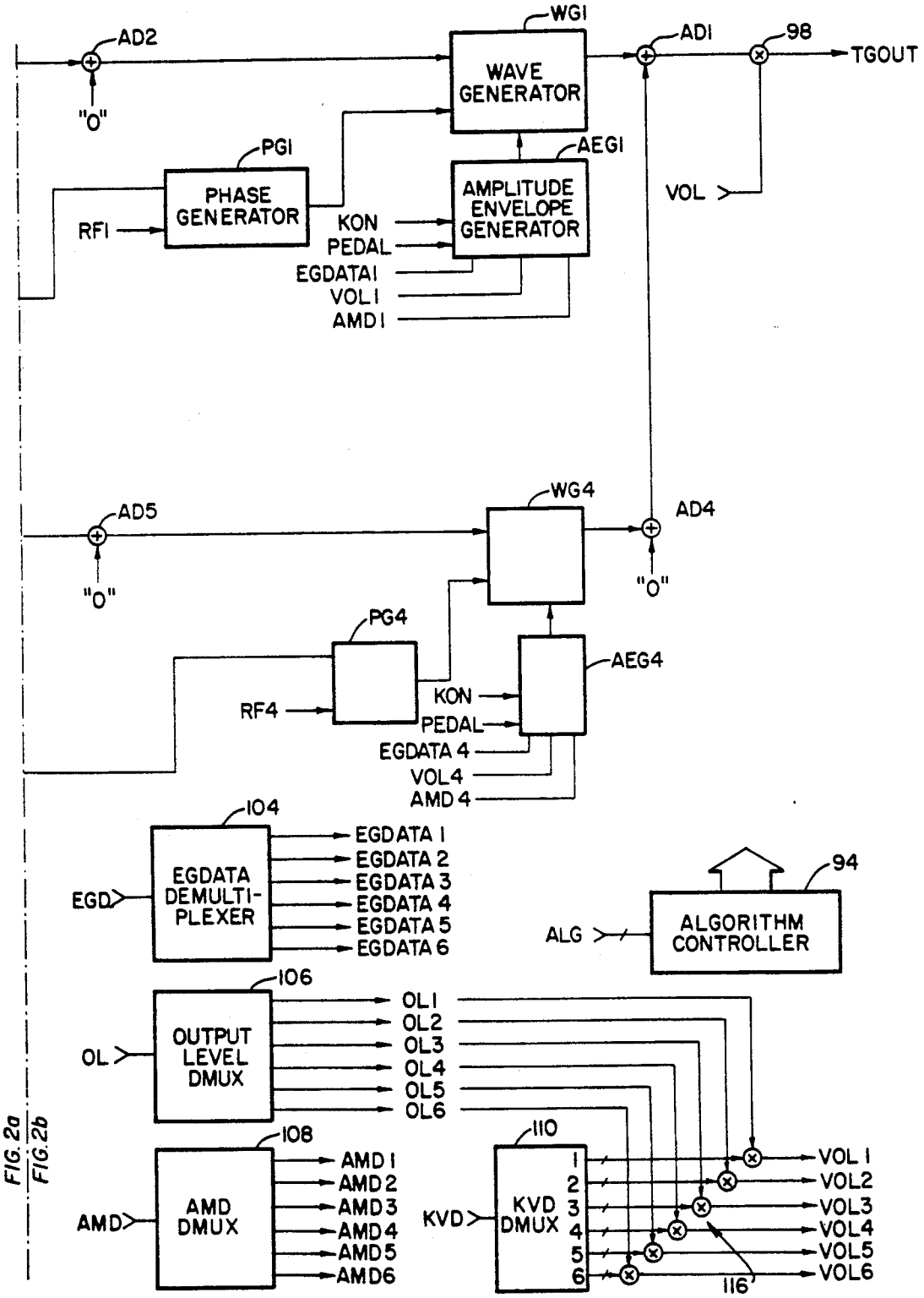

FIG. 2 is a block diagram of the tone generator 70. The tone generator 70 has six operators OP1 to OP6. Each operator OPi (i=1, 2, . . . 6) comprises a wave generator WGi, a phase generator PGi, and an amplitude-envelope generator AEGi.

Figure 3:
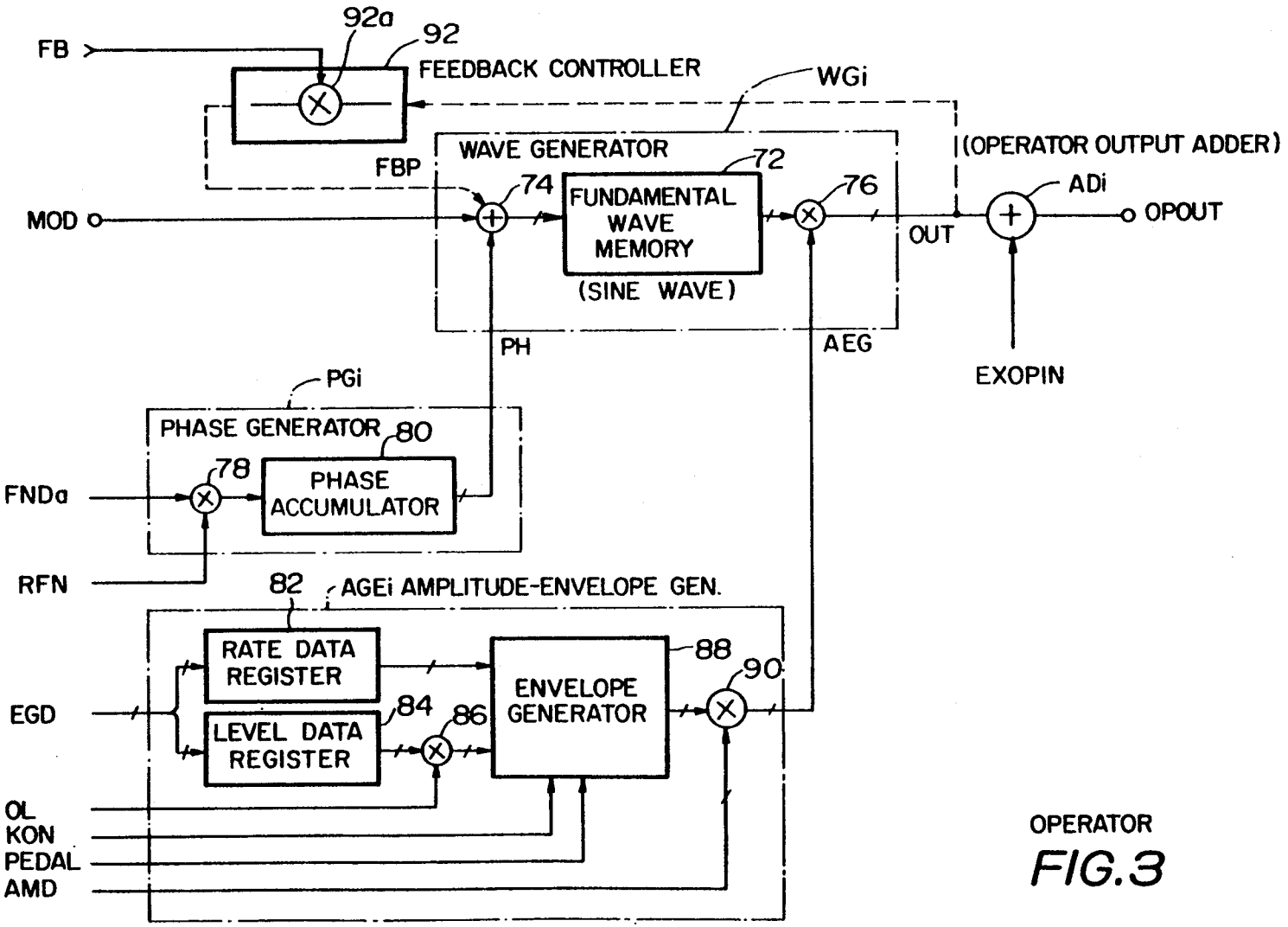
FIG. 3 is a block diagram of an operator in the tone generator 70.

The wave generator WGi, as shown in FIG. 3, includes a fundamental wave memory 72 that contains data representing a single sine wave, an adder 74 that adds phase-angle data PH and modulation data MOD, and a multiplier 76 that multiplies output data from the fundamental wave memory 72 by envelope data AEG from the amplitude-envelope generator AEGi.

The phase generator PGi has a multiplier 78 and a phase accumulator 80. The multiplier 78 multiplies the frequency-number data FNDa by ratio-of-frequency data RFi, which will be described later. The product of these data is applied to the phase accumulator 80 that accumulates the product to produce phase-angle data PH.

The phase-angle data PH is supplied to the adder 74 and added to the modulation data MOD to produce address data of the fundamental wave memory 72. Consequently, the sum of phase-angle data PH and modulation data MOD determines an address of the fundamental wave memory 72 from which sine data is read. The output data of the fundamental wave memory 72 is applied to the multiplier 76 where it is multiplied by the envelope data AEG and the product thereof is produced as output data of the wave generator WGi.

The envelope data AEG is generated in the amplitude-envelope generator AEGi. The envelope, as is well known, usually consists of four segments; attack, decay, sustain, and release. The first segment, the attack portion of an envelope, is the very beginning of a sound. It begins at key-on timing or after a predetermined period thereof (delayed modulation). In the first segment, the amplitude of the envelope increases at a constant rate until it reaches a peak level. In the second portion, i.e., decay, the amplitude decreases at a constant rate to the sustain level (the third segment). In the third segment, the amplitude remains at a fixed level for as long as the note is held, that is, for as long as the key is depressed. Once a key is released, a sound enters the fourth segment, i.e., release segment, where the envelope decreases from the sustain level to zero amplitude at a constant rate.

These rates and levels are supplied to data registers 82 and 84 from the data transfer controller 18 as envelope-generation data. The rate data register 82 stores rate data of each segment, whereas the level data register 84 stores level data thereof. Output of the level data register 84 is applied to a multiplier 86 where it is multiplied by output-level data OL. The data OL is also supplied from the data transfer controller 18 as one of the tone-color data. The outputs of the rate data register 82 and the multiplier 86 are supplied to an envelope generator 88 that generates an envelope waveform using key-on data KON and pedal (sustain) data PEDAL. The key-on data indicates the starting point of the attack segment, and sustain data PEDAL maintains the sustain segment. The envelope produced from the envelope generator 88 is applied to a multiplier gO where it is multiplied by the amplitude-modulation data AMD which is also supplied from the data transfer controller 18 as one of the tone-color data. Thus the amplitude-envelope data AEG is produced, and supplied to the multiplier 76 to modulate the output data from the fundamental wave memory 72. The output of the multiplier 76 is applied to an operator-output adder ADi which adds it to output data EXOPIN from another operator.

An operator OPi may have a feedback loop that returns a portion of output thereof back to its input. The feedback loop is provided with a feedback controller 92 that controls the feedback amount in accordance with the feedback data FB supplied from the feedback select switch 52 (see FIG. 1). The select switch 52, as previously mentioned, selects the feedback level from the data transfer controller 18 or key-velocity data from the velocity processor 50. While the feedback level is fixed at a constant level as long as a tone color is not changed, the key-velocity data varies at every key depression. The selected data is supplied to the feedback controller 92 as feedback data. In practice, the feedback controller 92 comprises a multiplier 92*a* which multiplies the output data of the operator OPi by the feedback data FB whose value is represented by $\beta$ (from now on, it is called feedback parameter $\beta$).

Figure 5:
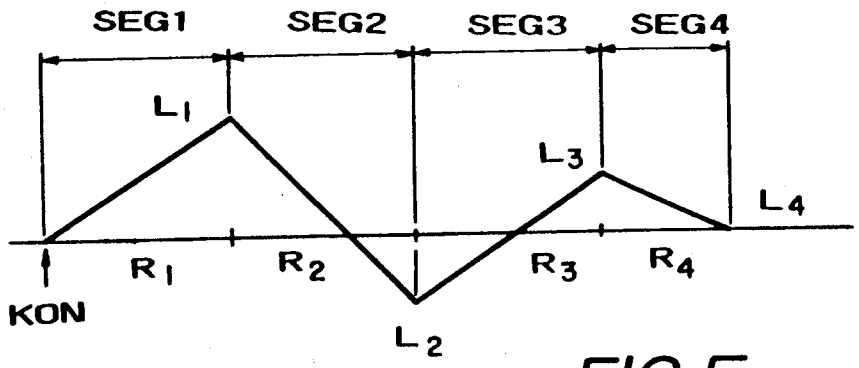
FIG. 5 is a diagram showing a pitch modulation envelope generated by the pitch-envelope generator 28.

The six operators OP1 to OP6 can be connected in an arbitrary fashion as shown in FIG. 5 of the U.S. Pat. No. 4,554,857 by changing connections between outputs and inputs of the operators OP1 to OP6. FIG. 2 shows one of these configurations that corresponds to A-3 in FIG. 5 of the U.S. Pat. No. 4,554,857. Operators OP1 to OP3, and OP4 to OP 6 are respectively connected in a cascade and the output data of operators OP1 and OP4 are added by the operator output adder AD1. Other configurations are also obtained by changing connections between the operators OP1 to OP6 by an algorithm controller 94. The algorithm controller 94 consists of logic circuits such as registers and logic gates and operates so that a designated configuration by algorithm data ALG is achieved.

Here, input data to operators OP1 to OP6 will be described. There are two groups of input data: data which are constant as long as a tone color is not changed, and data which vary continuously. The constant data are those supplied from the data transfer controller 18: individual-operation data IDVOP, frequency data FREQ, envelope-generation data EGD, output-level data OL, and algorithm data ALG mentioned above. In contrast, varying data are those supplied from other portions of the main controller; frequency-number data FND, feedback data FB, pitch-modulation data PMD, amplitude-modulation data AMD, key-velocity data KVD, and volume data VOL.

The frequency-number data FND from the keycode/frequency-number converter 24 (see FIG. 1) is supplied to an adder 96 where it is added to common pitch-modulation data CMN PMD mentioned below, to produce new frequency-number data FNDa. The frequency-number data FNDa is applied to all the phase generators PG1 to PG6. The volume data VOL from the interface controller 2 is supplied to a multiplier 98 where it is multiplied by the output from the adder AD1 of the operator OP1, and the product is produced as tone generator output TGOUT. The feedback data FB is applied to the feedback: controller 92 of the operator OP6 to control the feedback parameter $\beta$.

The other data PMD, IDVOP, FREQ, EGD, OL, AMD, and KVD include data for each of six operators OP1 to OP6 in a time division fashion, and they are separated by use of 1-to-7 or 1-to-6 line demultiplexers.

A PMD demultiplexer 100, a 1-to-7 line demultiplexer, separates pitch-modulation data PMD into common pitch-modulation data CMN PMD, and six individual pitch-modulation data corresponding to six operators OP1 to OP6. An RF demultiplexer 102, a 1-to-6 line demultiplexer, divides ratio-of-frequency data FREQ into six individual data. Also, an EG demultiplexer 104 separates envelope-generation data EGD into six individual data EGDATA1 to EGDATA6, an output level demultiplexer 106 divides output-level data OL into six individual output data OL1 to OL6, an AMD multiplexer 108 separates amplitude-modulation data AMD into six individual amplitude-modulation data AMD1 to AMD6, and KVD demultiplexer 110 divides key-velocity data KVD into six individual data.

Six individual pitch-modulation data from the PMD demultiplexer 100 are supplied to a gate circuit 112 having six switches, each of which selects either individual pitch-modulation data or logic-0 data under the control of individual-operation data IDVOP. Output data of the gate 112 are added to output data of the RF demultiplexer 102 using adders 114 to produce six individual rate of frequency data RF1 to RF6. The individual rate of frequency data RFi is supplied to phase generator PGi to modulate the frequency-number data FNDa.

Output-level data OL1 to OL6 from the output level demultiplexer 106 are applied to multipliers 116 where they are respectively multiplied by output data of KVD demultiplexer 110 to produce six individual volume data VOL1 to VOL6. The data VOLi, EGDATAi, and AMDi as well as key-on data KON and pedal data PEDAL are supplied to amplitude-envelope generator AEGi of each operator OPi.

According to the tone generator 70 shown in FIG. 2, phase-angle data PH produced by the phase generator PGi varies independently of those generated by the other phase generators PGj (j = 1, 2, . . . 6 except i). This is because, although the frequency data FREQ is kept constant as long as tone color is not changed, the individual pitch-modulation data from the PMD demultiplexer 100 for each of operations OP1 to OP6 varies independently in accordance with time, and hence the ratio-of-frequency data RFi varies independently of the other data RFj, if the switch in gate 112 corresponding to data RFi is connected to the PMD demultiplexer 100. Conventionally, because all the phase generators operate by use of the same frequency-number data, they produce the same phase data. Hence, the sound lacks thickness and a lifelike quality. On the other hand, the phase generators PG1 to PG6 of the embodiment are capable of selectively modulating the same frequency-number data FNDa by the ratio-of-frequency data that vary independently of the other ratio-of-frequency data. Thus, the tone generator 70 according to the present invention can achieve thicker, more dynamic, lifelike sound rich in harmonics.

Furthermore, because the feedback parameter $\beta$ of the operator OP6 can be varied by the key velocity, large and dynamic change in tone color is achieved by touch. Generally speaking, larger feedback parameter $\beta$ produces more drastically changing tone color and richer harmonics, and actual musical instruments are apt to produce richer harmonics with stronger touch. Consequently, to achieve the better simulation of actual musical instruments, the tone generator 70 is preferably designed so that stronger touch produces larger feedback parameter $\beta$. This is performed by adjusting the velocity curve in the velocity processor 50. Thus, touch sensitive, drastically changing, dynamic, lifelike tone color can be achieved. Moreover, since the key-velocity data KVD corresponding to key velocity KV is freely altered by changing the velocity curve in the velocity processor 50, changing range of tone color is free to set for each key number. The velocity curve is also variable for every tone color, hence the touch sensitivity of each tone color is free to set.

The feedback parameter $\beta$ is also altered by use of a $\beta$-envelope generator. It is designed so that it is triggered by key on data KON and generates a waveform which modulates the feedback parameter $\beta$, just as other envelope generators. In addition, the envelope waveform can be further modulated to produce more complex envelopes.

Figure 4:
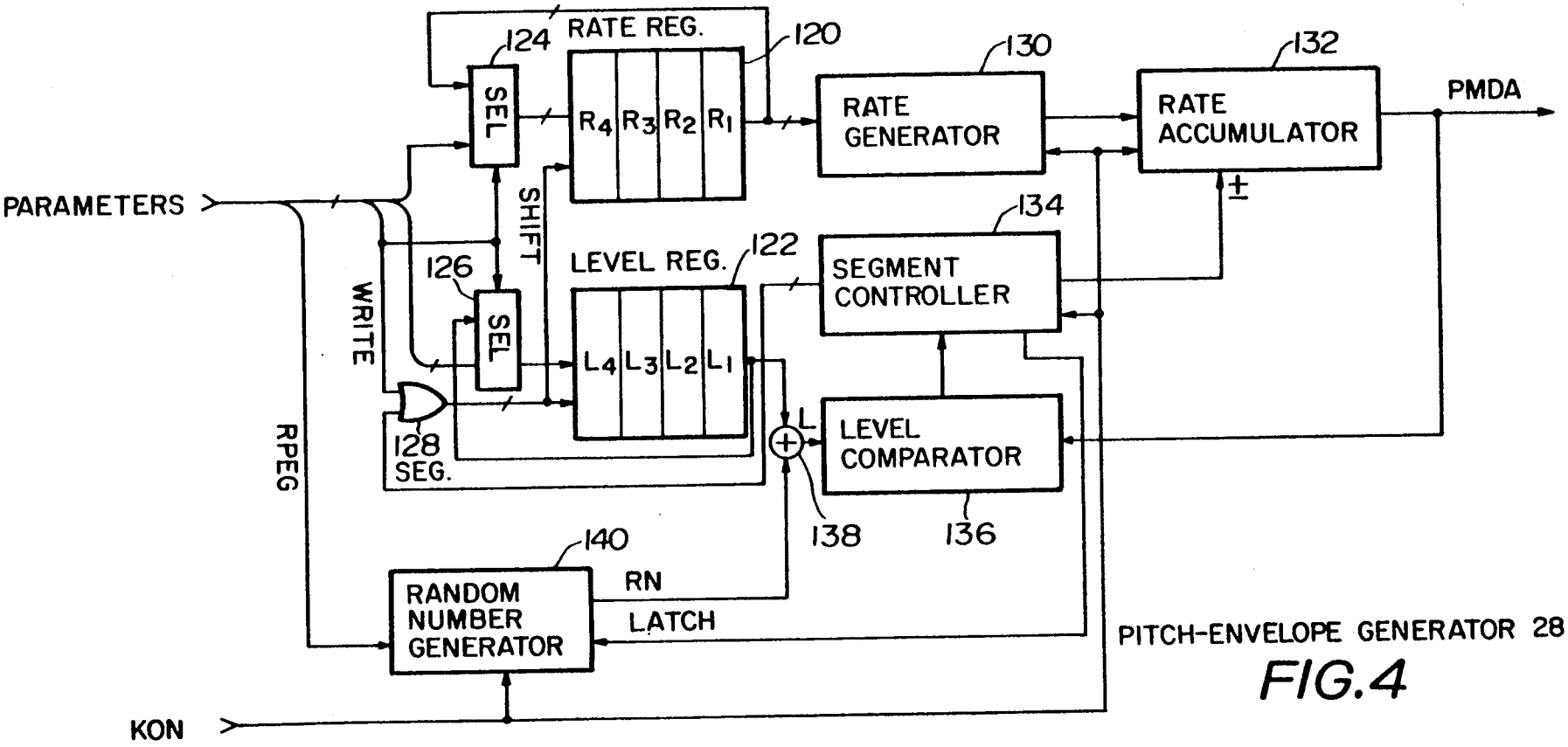
FIG. 4 is a block diagram of a pitch-envelope generator 28 in the main controller.

FIG. 4 is a block diagram of the pitch-envelope generator 28 shown in FIG. 1. It includes a pair of registers that keep envelope parameters; a rate register 120 and a level register 122. A pitch envelope, for example, has four segments SEG1 to SEG4 as shown in FIG. 5. The segment SEG1 starts at every key-on timing (or at a predetermined time thereafter) and increases its amplitude at a constant rate R1 till it reaches a peak level L1. The next portion of the envelope, the segment SEG2, begins at the peak level L1 and decreases at a constant rate R2 until a bottom level L2. Similarly, the segment SEG3 increases its amplitude to a peak level L3 at a constant rate R3, the segment SEG4 decreases its amplitude to a level L4 at a constant rate R4. These parameters R1 to R4 and L1 to L4 together with a write parameter WRITE and a random mode parameter RPEG (random pitch envelope generation) are supplied as tone color parameters from the data transfer controller 18 in FIG. 1.

Rate parameters R1 to R4 and level parameters L1 to L4 are respectively applied to data selectors 124 and 126. When the write parameter WRITE is supplied to selection terminals of selectors 124 and 126, they select rate parameters R1 to R4 or level parameters L1 to L4 transferred from the data transfer controller 18, and apply them to registers 120 and 122. These parameters are sequentially written into registers 120 and 122 using the write parameter WRITE from an OR gate 128 as a shift pulse before a performance.

The rate register 120 consists of four-stage parallel-in parallel-out circular shift register. Each stage contains one of the four rate parameters R1 to R4 and these rates are circulated through the selector 124 by a shift pulse SHIFT. The level register 122 has the same construction as the rate register 120 and contains four level parameters L1 to L4 which are circulated through the selector 126 by the shift pulse SHIFT in synchronization with rate parameters R1 to R4.

The rate parameters R1 to R4 are sequentially read from the rate register 120 and supplied to a rate generator 130. The rate generator 130 converts the rate parameters to difference values according to a predetermined characteristic curve and applies it to a rate accumulator 132. The rate accumulator 132 accumulates the difference value in increasing or decreasing direction in accordance with indication from a segment controller 134.

Output data of the rate accumulator 132, i.e., an envelope generated is supplied to a level comparator 136 where it is compared with the level of the current segment. The level comparator 136 produces equal signals and applies them to the segment controller 134 whenever amplitude of each segment reaches the peak level thereof. Thus the equal signals are produced when the amplitude of the envelope reaches level L1, L2, L3, and L4, that is, at each end of segments SEG1 to SEG4. When each segment is over, segment controller 134, receiving the equal signal, sends a signal SEG to the OR gate 128 and the signal is transferred to the registers 120 and 122 as a shift pulse SHIFT. As a result, the rate parameters R1 to R4 and level parameters L1 to L4 are sequentially shifted and circulated in the respective registers 120 and 122 via selectors 124 and 126. Thus rate parameters R1 to R4 are sequentially supplied to the rate generator 130, whereas the level parameters L1 to L4 are supplied to an adder 138. The adder 138 adds the current level parameter to a random number applied from a random-number generator 140. The random-number generator produces a random number at every segment.

Figure 6:
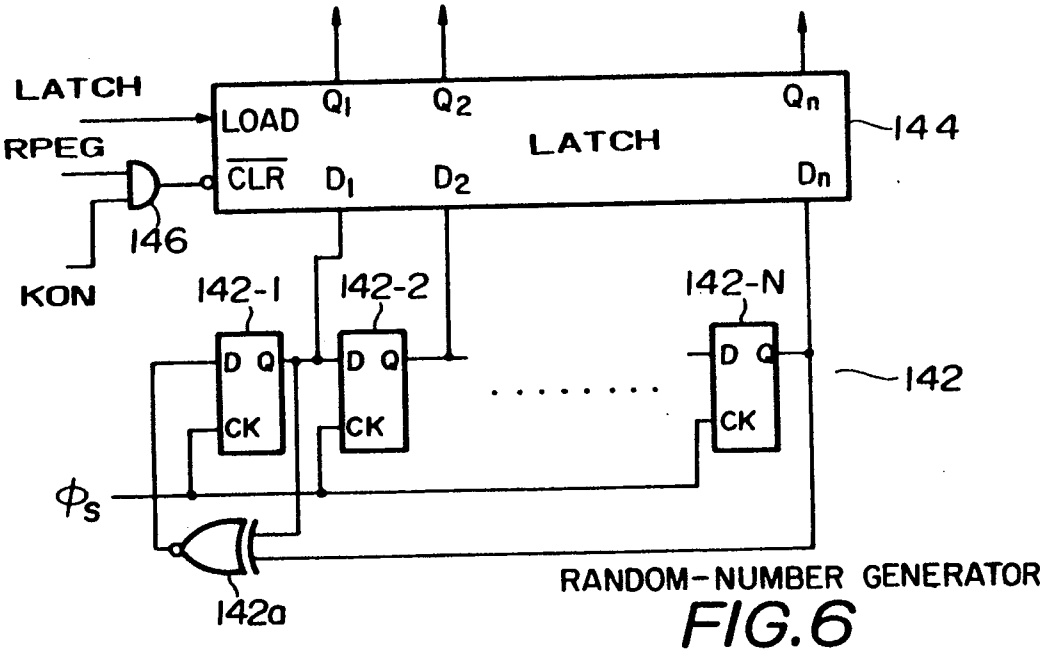
FIG. 6 is a circuit diagram showing a configuration of a random-number generator in the pitch-envelope generator 28.

FIG. 6 shows a construction of the random-number generator 140. It comprises M-series random-number generator 142 and a N bit latch 144. The M-series random-number generator 142, as is well known, has N D-flip-flops 142-1 to 142-N connected in a serial fashion and a exclusive OR gate 142*a*, and produces a random number RN. The random number RN is applied to the latch 144 and loaded to it by latch signal LATCH supplied from the segment controller 134 at every starting point of the segments SEG1 to SEG4. Before loading, the latch 144 is cleared by key-on data KON supplied via an AND gate 146 that ANDs the key-on and random mode parameter RPEG. Thus random numbers added to the level parameter L1 to L4 vary at every key-on timing and starting points of four segments.

Figure 7A:
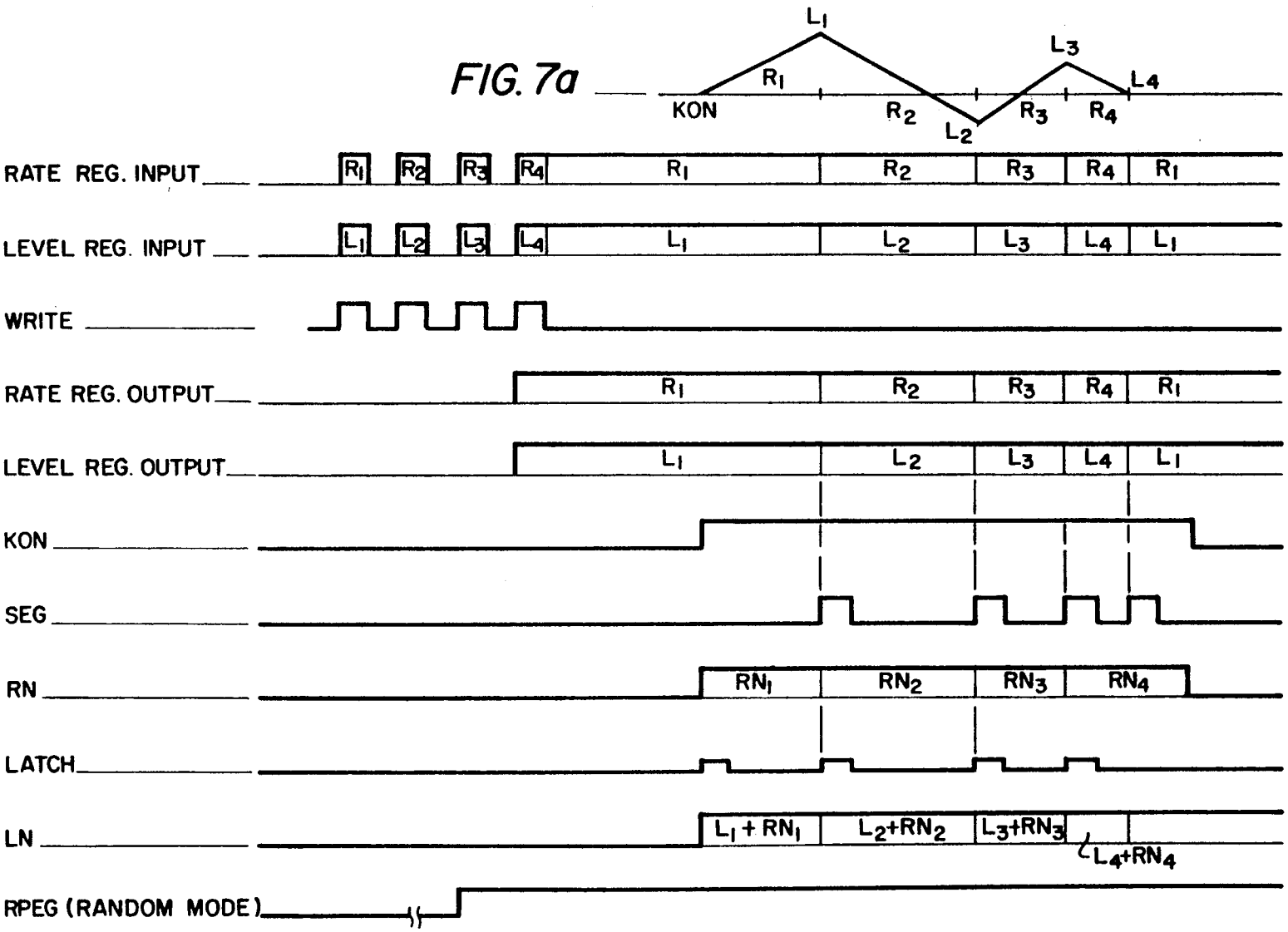
FIG. 7 is a timing chart showing operation of the pitch-envelope generator 28.

FIG. 7 is a timing chart showing the operation of the pitch-envelope generator 28.

Rate parameters R1 to R4 and level parameters L1 to L4 are loaded before a performance as shown in FIG. 7 (b) to (d) by write parameter WRITE. At this timing, output parameters of the rate register 120 and level register 122 are R1 and L1 respectively (see (e) and (f)). In the case of random mode, random mode parameter RPEG is kept at a high level as shown in (1). When a key-on data KON is supplied (see (g)), it clears the rate accumulator 132 and the latch 144 in the random-number generator 140. At the same time, the rate generator 130 loads rate parameter R1, and the adder 138 adds level parameter L1 and random number RN1 to provide the result L1′ (=L1+RN1) to the level controller 136 (see (i) to (k)). Thus, the rate accumulator 132 begins to produce the first segment SEG1 (see (a)). When the amplitude of the first segment SEG1 reaches L1′, the level comparator 136 provides equal signal to segment controller 134 which in turn supplies segment signal SEG to the OR gate 128. The OR gate 128 sends the signal as shift pulse SHIFT to the registers 120 and 122 to circulate the contents thereof. Similar operations are performed for each segment SEG2 to SEG4, and the envelope shown in FIG. 7 (*a*) is produced from the rate accumulator 132.

Figure 8:
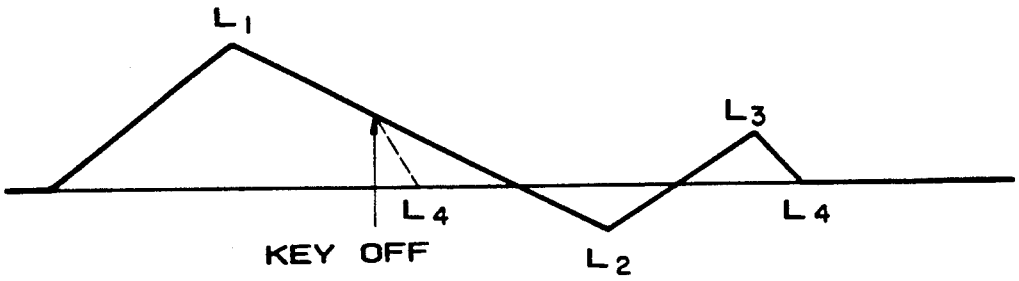
FIG. 8 is a diagram showing a pitch envelope generated by the pitch-envelope generator 28 in case where a key is released before the envelope reaches the fourth segment.

FIG. 8 shows an envelope waveform when a key is released before the fourth segment SEG4 starts. In this case, the envelope decreases from the key-off point to the level L4 at the rate of R4.

The pitch-envelope generator 28, as described above, employs the random-number generator 140 and modifies the end level of segments SEG1 to SEG4. Hence simulation of a performance of an actual musical instrument is achieved.

Figure 9A:
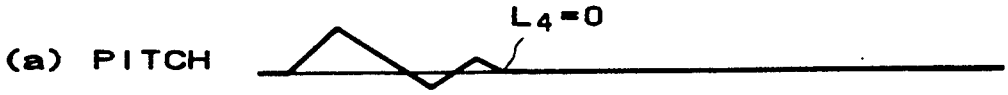
FIG. 9 is diagram showing relation between a pitch envelope generated by the pitch-envelope generator 28 and an amplitude envelope generated by the amplitude-envelope generator AEGi to explain the effect of level L4.
Figure 9B:
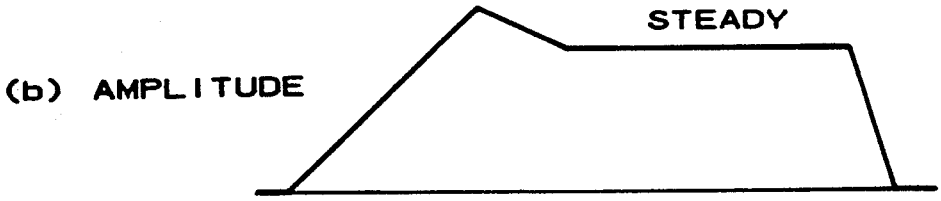

Some alternatives or variations of the pitch-envelope generator 28 are proposed as follows. (a) In actual performances of wind instruments, most pitch variation occurs at the attack portion as shown in FIG. 9. To simulate it and achieve natural musical tone, the level L4' must be zero. This is because pitch deviation at steady portion during key depression occurs unless the level L4' is zero (see FIG. 9 (b)). In order to avoid the pitch deviation, the level L4' must be maintained at zero. This is accomplished by resetting the latch 144 by the third equal signal produced at the end of the third segment SEG3, so that the modulation of the level L4 (=0) by a random number is prevented.

Figures 10, 12:
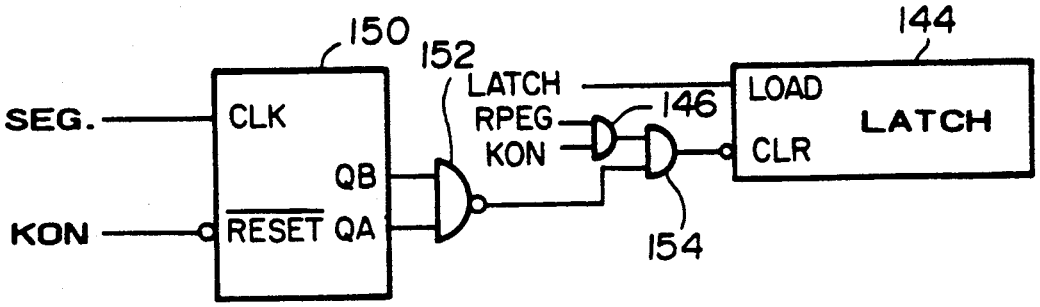
FIG. 10 is a block diagram showing a circuit construction to prevent pitch variation during the steady portion of the amplitude envelope shown in FIG. 9 (*b*)
FIG. 12 is a table showing a construction of a key code.

FIG. 10 shows a circuit diagram to achieve the operation. A counter 150 is reset by every key-on data KON and counts the signal SEG. When its content becomes three, logic-0 appears at output terminal of a NAND gate 152 and it clears the latch 144 through an AND gate 154. Thus the latch is reset at the end of the third segment SEG3, so that the modulation of level L4 by the random number RN4 is avoided.

Figure 11:
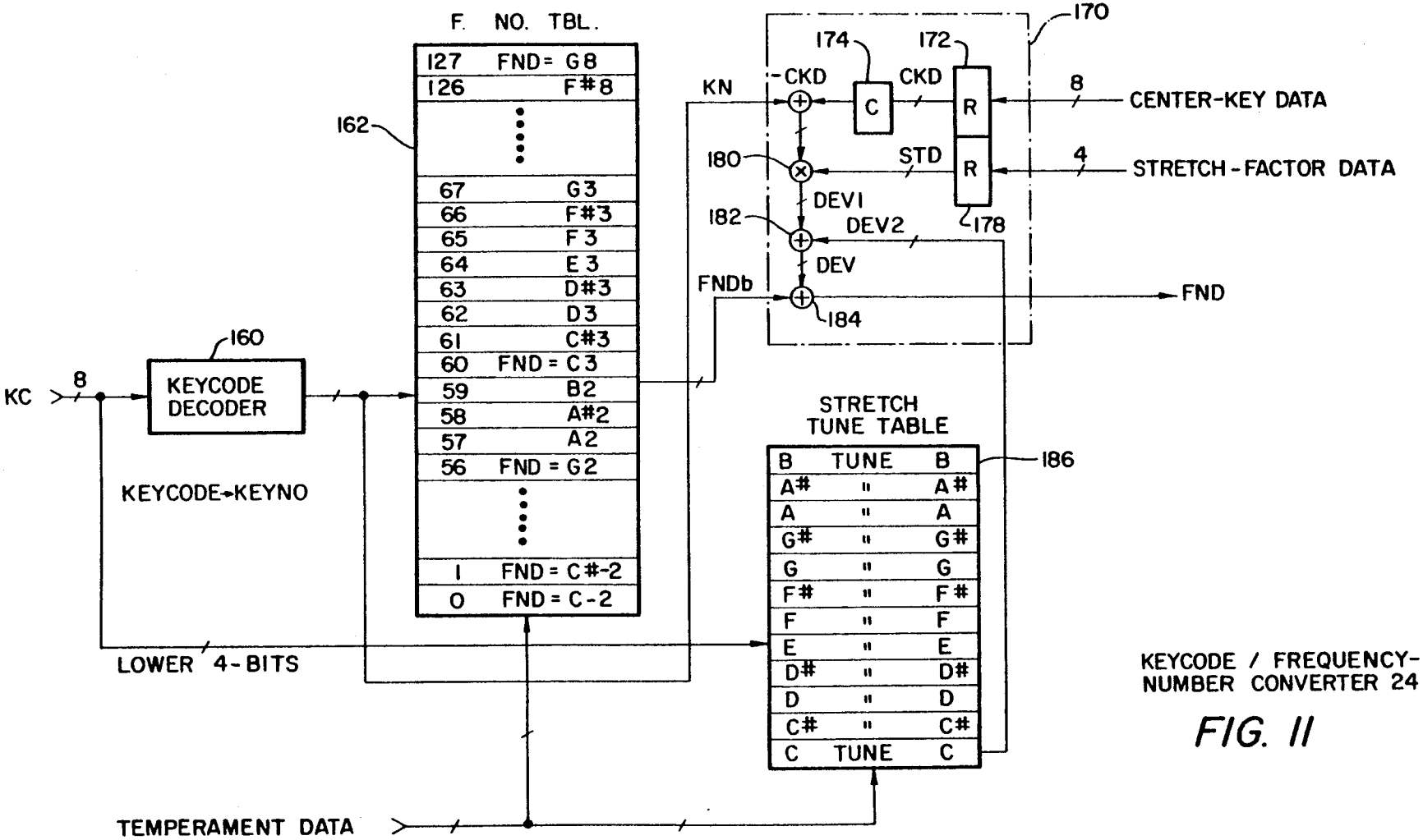
FIG. 11 is a block diagram showing a construction of a keycode/frequency-number converter 24 of the main controller.

FIG. 11 is a block diagram of the keycode/frequency-number converter 24. An 8-bit keycode KC from the interface controller 2 in FIG. 1 is applied to a keycode decoder 160 where it is converted to a key number. The keycode KC is constructed as shown in FIG. 12. It has 8 bits whose lower half represents key names and upper half indicates octaves to which the key names belong. The key number is supplied to a frequency-number table 162 to be converted to the corresponding frequency-number data FNDb. For example, if a key number is 60, frequency-number data C3 is read out from the frequency-number table 162. Frequency-number data FNDb is modified as will be described below.

To modify frequency-number data FNDb, there are three parameters to be considered: Center key data CKD, stretch-factor data SFD, and key-number data KN.

Figures 13, 14:
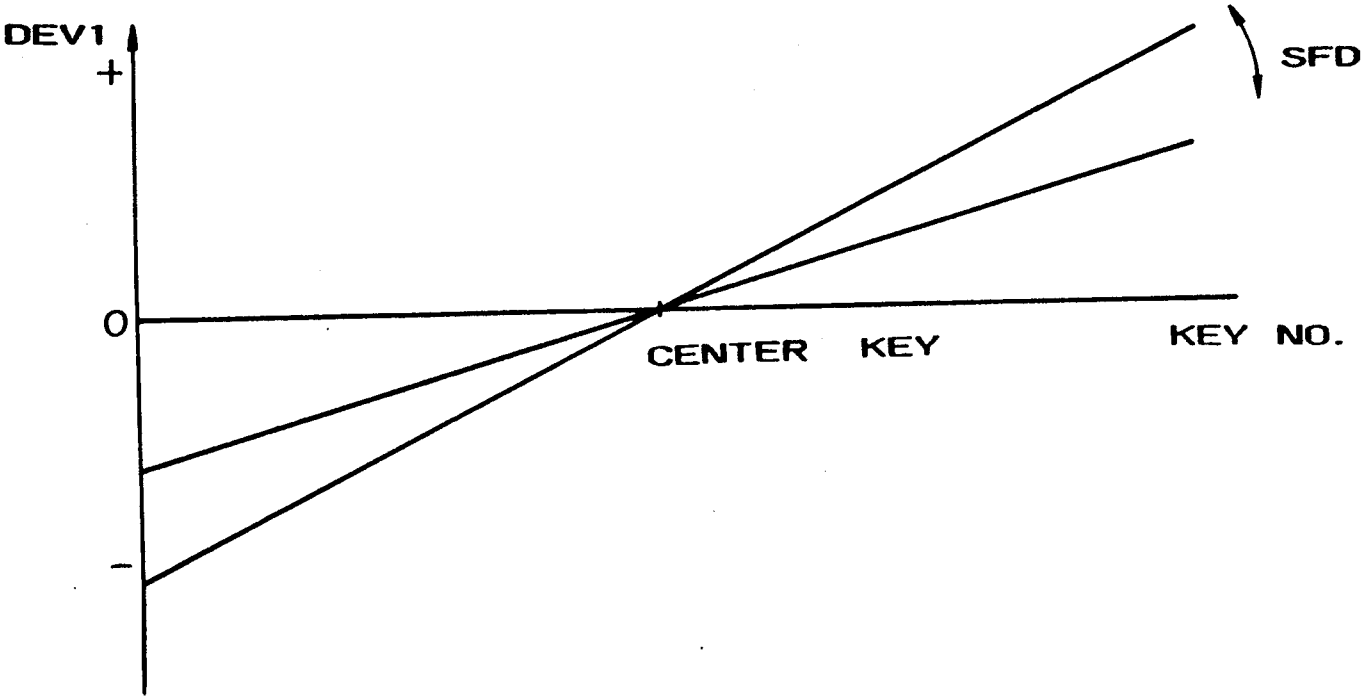
FIG. 13 is a graphic diagram showing relation between key number and corresponding deviation from equal temperament.
FIG. 14 is a table showing a deviation of each note within an octave.

FIG. 13 shows the relationships of these parameters. Deviation from equal temperament is set so that it is zero at a predetermined center key, and varies in proportion to the key number. The proportional constant is called a stretch-factor data SFD. The deviation DEV1 from equal temperament at a given key is expressed by the following equation.

$$DEV1=(KN-CKD)*SFD \quad (1)$$

Figure 15:
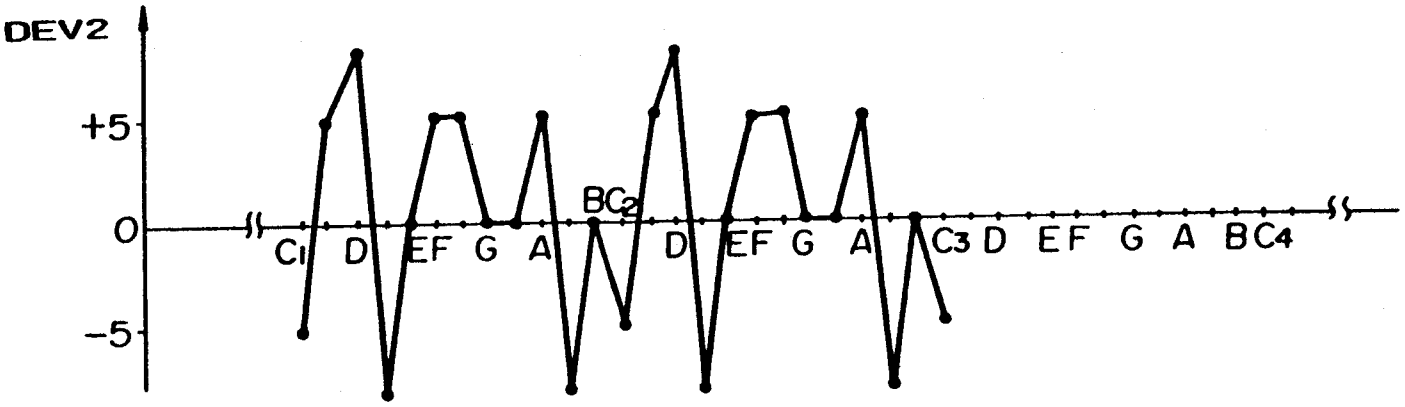
FIG. 15 and FIG. 16 are graphic diagrams showing relation between notes in an octave and deviations thereof from equal temperament.

Furthermore, another deviation DEV2 from the equal temperament within an octave can be provided by setting arbitrarY value to each note. FIG. 14 to 15 show an example of the deviation DEV2. The deviation DEV2 is intentionally provided to simulate a "honky-tonk piano".

Figure 16:
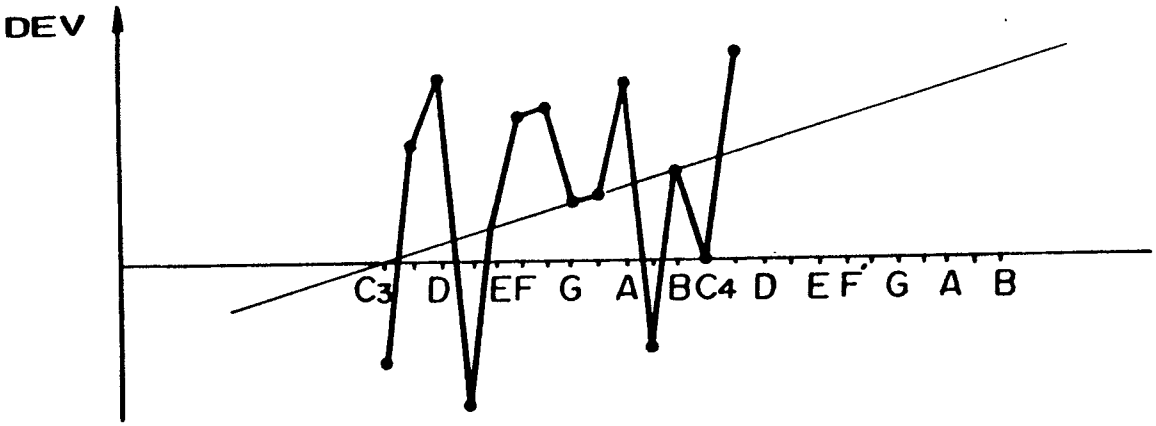

Sum of these deviation DEV1 and DEV2 gives a total deviation DEV from the equal temperament as shown in FIG. 16 and is expressed as follows.

$$DEV=DEV1+DEV2=(KN-CKD)*SFD+DEV2 \quad (2)$$

The deviation DEV is added to the frequency-number data FNDb so that the resulting frequency-number data FND is expressed as, $$FND=(KN-CKD)*SFD+DEV2+FNDA \quad (3)$$

The computation so far described is performed by the computing portion 170. First, 8-bit center-key data CKD is applied through a center-key register 172 to a complement circuit 174 where its complement is produced. The complement of the center-key data (−CKD) is supplied to an adder 176 where it is added to the key number KN provided from the keycode decoder 160. Thus (KN−CKD) is obtained from the adder 176 Second, 4-bit stretch factor data SFD is applied through a register 178 to a multiplier 180 where it is multiplied by the output data from the adder 176. Hence, the output of the multiplier 180 is (KN−CKD)*SFD (=DEV1) as given by the equation (1). Third, deviation DEV2 is added to the deviation DEV1 by using an adder 182, and the sum DEV1+DEV2 (=DEV) is obtained. Finally, the sum DEV is supplied to an adder 184 where deviation DEV is added to the frequency-number data FNDb. The resultant sum is produced as the frequency-number data FND from the adder 184. The deviation DEV2 is prestored in a stretch tune table 186 and is supplied to the adder 184. An example of the contents of the stretch tune table 186 are shown in FIG. 14.

The data of the tables 162 and 186 are supplied from the data transfer controller 18 as temperament data, and set thereto. The data transfer controller 18 retrieves these data from the tone-color-data memory 16 and transfers them to tables 162 and 186. When temperament data has no deviation from equal temperament, master tuning is carried out. On the other hand, if it has deviation as shown in FIG. 14, for example, the keycode/frequency-number converter 24 produces frequency-number data which simulates a "honky-tonk piano".

According to the keycode/frequency-number converter 24 described above, deviation from the equal temperament is computed from a few parameters. As a result, data for the tuning, whose deviations from equal temperament increase in proportion to the key number, are easily obtained.

Although the specific embodiment of an electronic musical instrument constructed in accordance with the present invention has been disclosed, it is not intended that the invention be restricted to either the specific configurations or the uses disclosed herein. Modifications may be made in a manner obvious to those skilled in the art. Accordingly, it is intended that the invention be limited only by the scope of the appended claims.

What is claimed is:

1. An electronic musical instrument, comprising:

frequency-number data generating means for generating a frequency-number corresponding to a musical tone frequency to be generated;

a plurality of operators respectively performing a waveform generation and frequency modulation thereof on the basis of at least one of frequency-number data and modulation data applied to at least one input of said operators, each of said operators being capable of generating a musical tone signal;

setting means for variably setting a combination of input and output connections between said respective operators;

connection switching means for switching connections between said respective operators in response to the combination of connections set by said setting means; and modulating means for selectively and independently generating frequency-number modulating data applied to at least one of said operators designated by said setting means thereby to frequency-modulate the frequency-number modulation data supplied thereto.

2. An electronic musical instrument as defined in claim 1 wherein said frequency-number modulation data is at least one of data correlating to pitch such as envelope data, low frequency data, controller pitch data, pitch bender data, aftertouch data, or key-velocity data.

3. An electronic musical instrument as defined in claim 1 wherein said operators perform delayed modulation in which the modulation starts after a predetermined time has elapsed from key on timing.

4. An electronic musical instrument, comprising:

means for entering performance information data;

a plurality of operators respectively performing a waveform generation and frequency modulation thereof on the basis of at least one of frequency-number data and modulation data applied to at least one input of said operators;

setting means for variably setting a combination of input and output connections between said respective operators;

connection switching means for switching connections between said respective operators in response to the combination of connections set by said setting means;

feedback means, provided for at least one of said operators, for feeding back output to an input of the same operator with variable feedback parameter $\beta$; and control data generating means for generating control data to control said feedback parameter $\beta$ in accordance with the performance information data.

5. An electronic musical instrument as defined in claim 4 wherein said external parameter is at least one of key-velocity data relating to key depression and key release and aftertouch data representing a degree of key depression strength when a key is continuously depressed.

6. An electronic musical instrument as defined in claim 4 further comprising envelope generating means for generating said external parameter to control the feedback parameter $\beta$.

7. An electronic musical instrument, comprising:

random number generating means for generating a random number;

pitch envelope generating means for generating pitch-modulation data in accordance with a random number supplied thereto;

a plurality of operators respectively performing a waveform generation in response to said pitch-modulation data, each of said operators being capable of generating a musical tone signal;

setting means for variably setting a combination of input and output connections between said respective operators; and connection switching means for switching connections between said respective operators in response to a combination of connections set by said setting means.

8. An electronic musical instrument as defined in claim 7 wherein said pitch envelope generating means generates said pitch-modulation data during every key depression timing.

9. An electronic musical instrument as defined in claim 7 wherein said pitch envelope generating means generates said pitch-modulation data by modulating pitch envelope parameters with a random number.

10. An electronic musical instrument as defined in claim 9 wherein said pitch envelope parameters are those representing levels of said pitch-modulation data.

11. An electronic musical instrument as defined in claim 9 wherein said pitch envelope parameters are those representing rates of said pitch-modulation data.

12. An electronic musical instrument, comprising:

means for generating a keycode corresponding to a musical note;

computing means for computing pitch deviation of each note from equal temperament on the basis of temperament parameters, said temperament parameters comprising center key data that defines a center key at which the pitch deviation from equal temperament is zero and a stretch factor that defines a predetermined function which changes pitch deviation in accordance with key number data representing pitch;

supplying means for supplying the temperament parameters to said computing means;

frequency-number data generating means for generating frequency-number data by converting a keycode thereto in accordance with a computed pitch deviation; and musical tone generating means for generating musical tones in response to the frequency-number data.

13. An electronic musical instrument as defined in claim 12 wherein said temperament parameters correspond to every pitch name and are read out according to a pitch name to be generated.

14. An electronic musical instrument, comprising:

means for generating a keycode corresponding to a musical note;

computing means for computing pitch deviation of each note from equal temperament on the basis of temperament parameters, said temperament parameters comprising center key data that defines a center key at which the pitch deviation from equal temperament is zero and a stretch factor that defines a gradient of the pitch deviation;

supplying means for supplying the temperament parameters to said computing means;

frequency-number data generating means for generating frequency-number data by converting a keycode thereto in accordance with a computed pitch deviation; and musical tone generating means for generating musical tones in response to the frequency-number data, said musical tone generating means comprising:

a plurality of operators respectively performing a waveform generation and modulation thereof on the basis of at least one of frequency-number data and modulation data applied to at least one input of said operators;

setting means for variably setting a combination of input and output connections between said respective operators; and connection switching means for switching connections between said respective operators in response to a combination of connections set by said setting means.

15. An electronic musical instrument, comprising:

means for generating a keycode;

memory means for storing pitch deviation data corresponding to each one of plural tone names in an octave;

frequency-number data generating means for generating frequency-number data by converting a keycode to the frequency-number data;

computing means for computing tone pitch data to be generated in accordance with said pitch deviation data and said frequency-number data corresponding to said keycode; and musical tone generating means for generating musical tones in accordance with said tone pitch data.

* * * * *